US006102452A

United States Patent [19]

Liau

[11] Patent Number: 6,102,452

[45] Date of Patent: Aug. 15, 2000

[54] LOCKING DEVICE FOR DOORS OR WINDOWS

[76] Inventor: Wan-Lai Liau, 3rd Floor, No.6 Chung Yang Rd., Nan Kang District, Taipei, Taiwan

[21] Appl. No.: 09/343,364

[22] Filed: Jun. 30, 1999

[51] Int. Cl.[7] ..... E05C 1/10

[52] U.S. Cl. ..... 292/175; 292/145; 292/262; 292/58; 292/61

[58] Field of Search ..... 292/175, 163, 292/145, 262, 6, 57, 58, 60, 61, 71, 67

[56] References Cited

U.S. PATENT DOCUMENTS

| | | | |
|---|---|---|---|
| 1,083,455 | 1/1914 | Mohn | 292/57 |
| 1,352,624 | 9/1920 | Polcek | 292/175 |
| 1,724,759 | 8/1929 | Gravel | 292/57 |
| 2,747,241 | 5/1956 | Marousky | 292/175 |
| 3,233,932 | 2/1966 | Utterback | 292/175 |
| 3,335,453 | 8/1967 | Lovelace | 292/175 |
| 3,626,507 | 12/1971 | Hawkins | 292/175 |
| 4,045,982 | 9/1977 | Gorton et al. | 70/90 |
| 4,270,779 | 6/1981 | Watts | 292/175 |

FOREIGN PATENT DOCUMENTS

| | | | |
|---|---|---|---|
| 207739 | 12/1923 | United Kingdom | 292/60 |

*Primary Examiner*—B. Dayoan
*Assistant Examiner*—John B. Walsh
*Attorney, Agent, or Firm*—Pro-Techtor International Services

[57] ABSTRACT

A locking device for doors or windows comprising:

a base member including an axially extended hole which has one end being formed as an oblong-shaped hole and the other end being formed with a round opening, the oblong-shaped hole having an axially extended inner wall;

a locking shaft, from a front end of the locking shaft there are formed in sequence with a ball-shaped handle, a circular ring, an oblong-shaped locking block cooperating with the oblong-shaped hole, an elongated round rod, and a thread portion at an end of the round rod for connecting with a locking head which has a diameter greater than the round rod, wherein the locking block, round rod and locking head can be received in the oblong-shaped hole and the round opening;

a spring mounting around the round rod, the spring having one end pushing on the inner wall of the oblong-shaped hole and the other end pushing on an inner surface of the locking head so as to keep the locking shaft at a pre-determined position relative to the base member. Therefore, the locking head can be received inside the round opening when the door/window is open such that the unexpected impact between the locking head and a shaft receiver may be prevented.

6 Claims, 11 Drawing Sheets

LOCKING DEVICE FOR DOORS OR WINDOWS

FIELD OF THE INVENTION

This invention relates to a locking device for use on doors or windows and particularly to a locking device which can be operated in a relatively easy and rapid manner.

BACKGROUND OF THE INVENTION

As shown in FIG. 11 and FIG. 12, a prior art locking device for doors and windows generally comprises:

a base member "A" which can be fixed on a door or window at a location near an edge thereof, the base member "A" being furnished with an elongated sleeve "A2" which has an axially extended hole "A1" penetrating therethrough, the sleeve "A2" being formed with an elongated guiding groove "A3" and at least one notch "A4" at one end of the guiding groove "A3" on the outer surface of the sleeve "A2";

a locking shaft "C" being received by the hole "A1" and being slidable along the hole "A1", the locking shaft "C" connecting with a handle "C1" by means of screw, the handle "C1" extending out of the guiding groove "A3" and being movable therealong such that the handle "C1" can be received by the notch "A4" when the handle "C1" is moved to one end of the guiding groove "A3";

a shaft receiver "B" having a shaft hole "B1" and being fixed on a frame "D" of the door or window at a place corresponding to the base member "A", by pushing the handle "C1" to make the locking shaft "C" moving along the hole "A1", the front end of the locking shaft "C" will plug into the shaft hole "B1" of the shaft receiver "B" so as to achieve the function of locking the door or window on the frame "D".

However, the above described prior art has the following deficiencies:

(1) During operation, firstly the user has to lift up the handle "C1" by his/her finger to make the handle "C1" rotate to leave the notch "A4", then push the handle "C1" sliding along the guiding groove "A3" to make the locking shaft "C" move along the hole "A1". Such an operation is not very handy.

(2) When the door/window is open (i.e., unlocked from the frame "D"), the front end of the locking shaft "C" is still very easy to extend out of the sleeve "A2". As a result, both the locking shaft "C" and the shaft receiver "B" are very easy to be damaged due to the impact between them when the door/window is closed again (as shown in FIG. 12).

SUMMARY OF THE INVENTION

It is therefore a primary object of the present invention to provide an improved locking device for doors or windows which can be operated handily and quickly. It is another object of the present invention to provide an improved locking device for doors or windows, wherein the front end of the locking shaft can be retained within the sleeve when the door/window is open so as to prevent the locking shaft from knocking the shaft receiver when the door/window is closed again.

BRIEF DESCRIPTION OF THE DRAWINGS

The present invention will hereunder be described in more detail with reference to accompanying drawings in which.

DETAILED DESCRIPTION OF THE INVENTION

Figure 1:
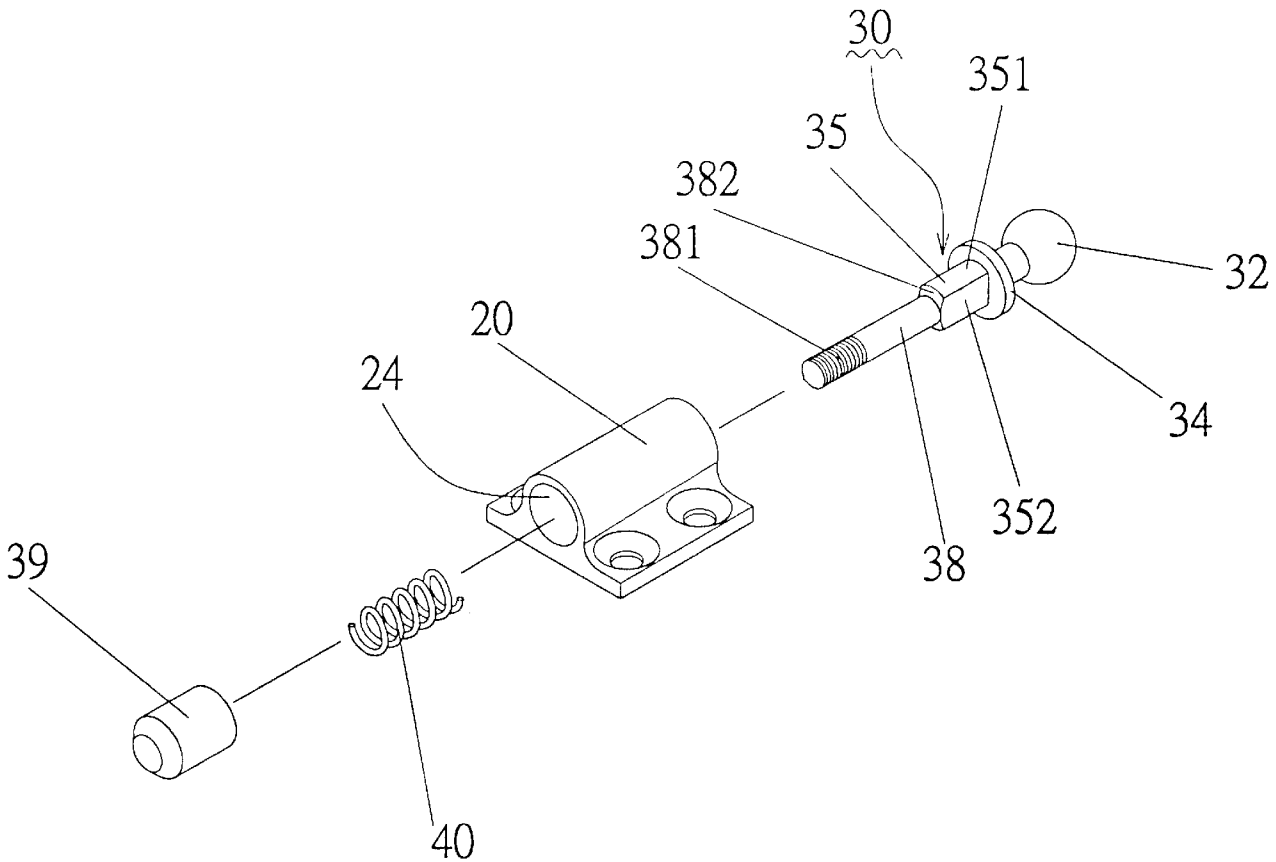
FIG. 1 is an exploded perspective view of a preferred embodiment of the locking device in accordance with the present invention.
Figure 2:
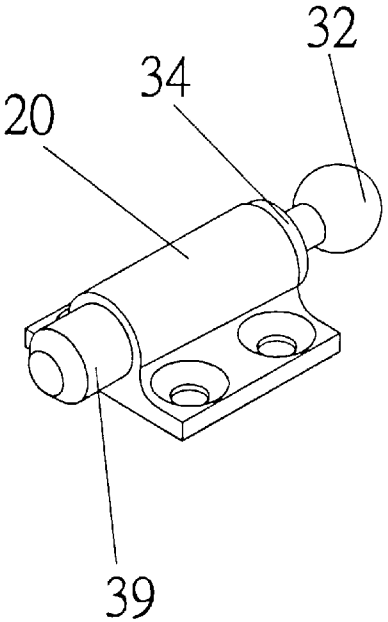
FIG. 2 is a perspective view of the locking device shown in FIG. 1 (being assembled).
Figure 6:
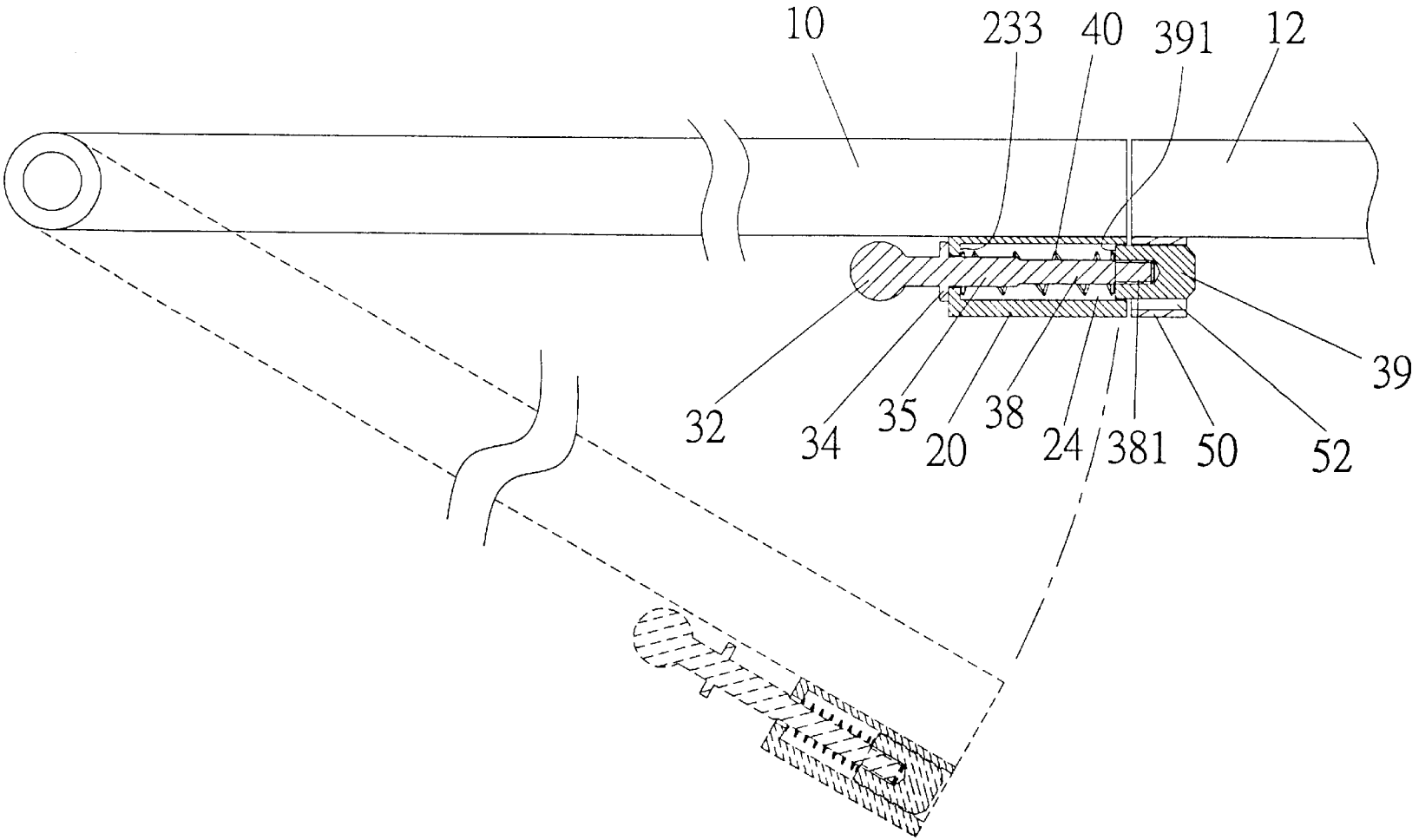
FIG. 6 is a cross sectional side view schematically showing the operation of the locking device furnished on the door/window.
Figure 7:
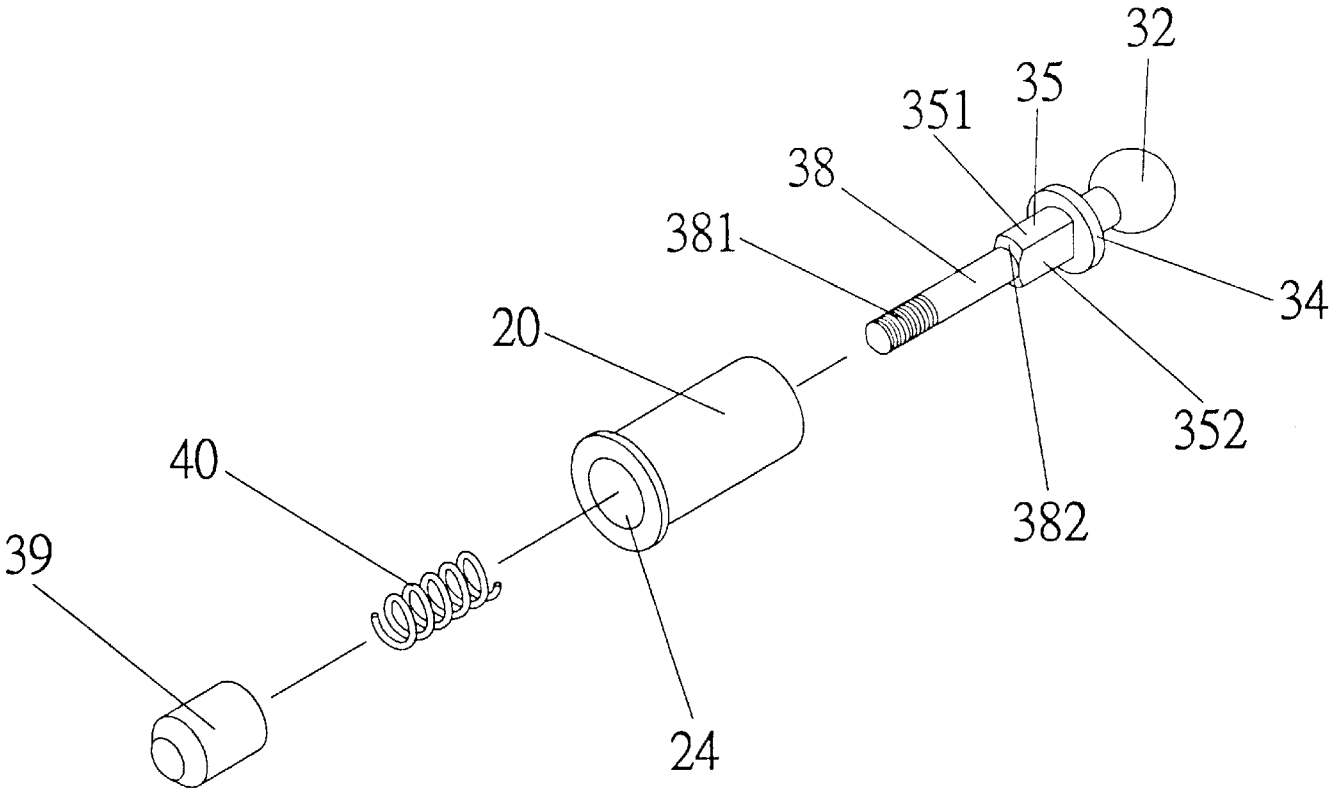
FIG. 7 is an exploded perspective view of another preferred embodiment of the present invention.
Figure 8:
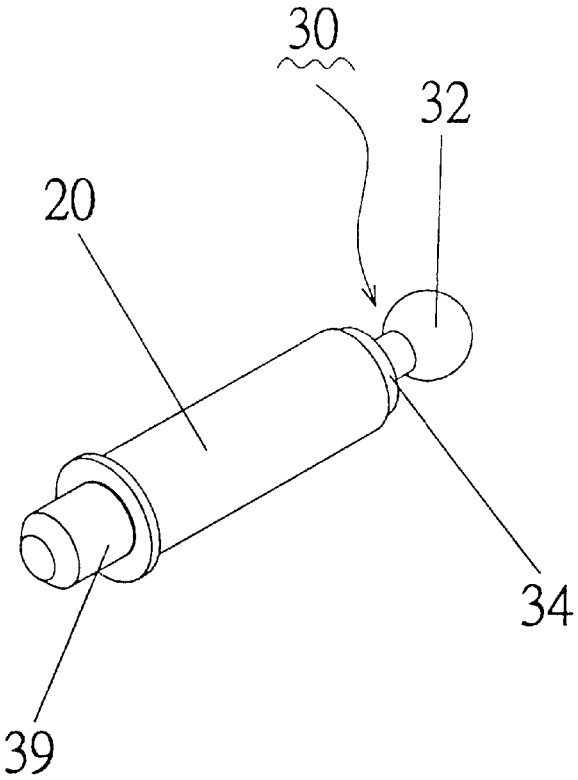
FIG. 8 is a perspective view of the locking device shown in FIG. 7 (assembled).
Figure 9:
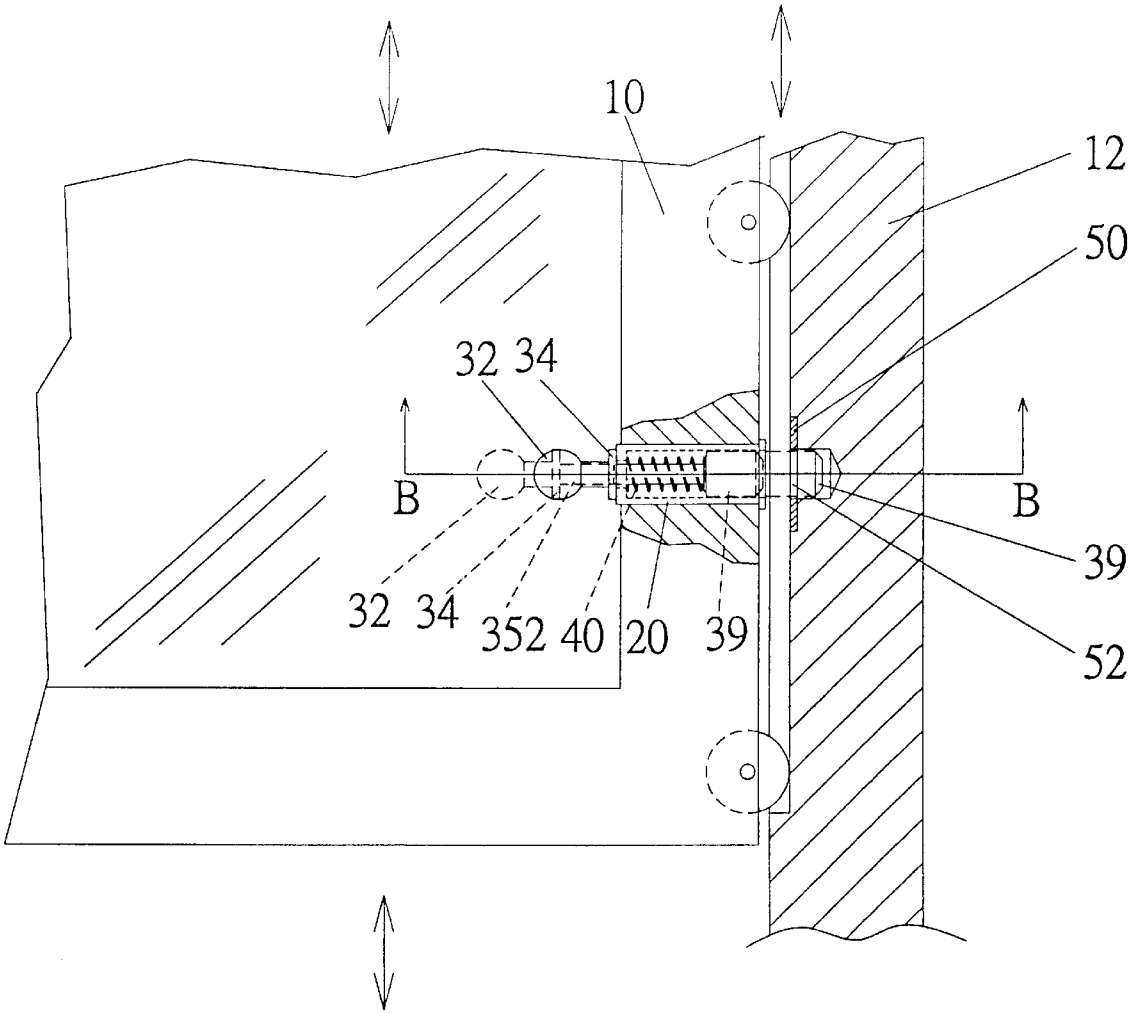
FIG. 9 a top view schematically showing the locking device shown in FIG. 7 being furnished in a door/window.
Figure 10:
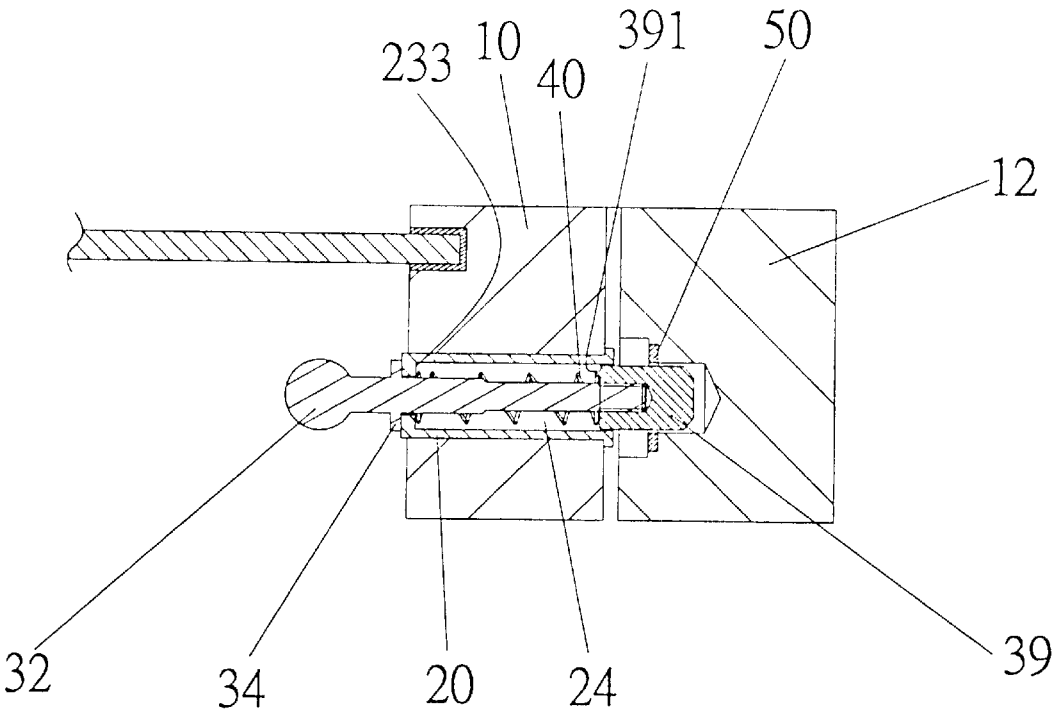
FIG. 10 is a sectional view of the locking device taken along the line B—B as shown in FIG. 9.
Figure 11:
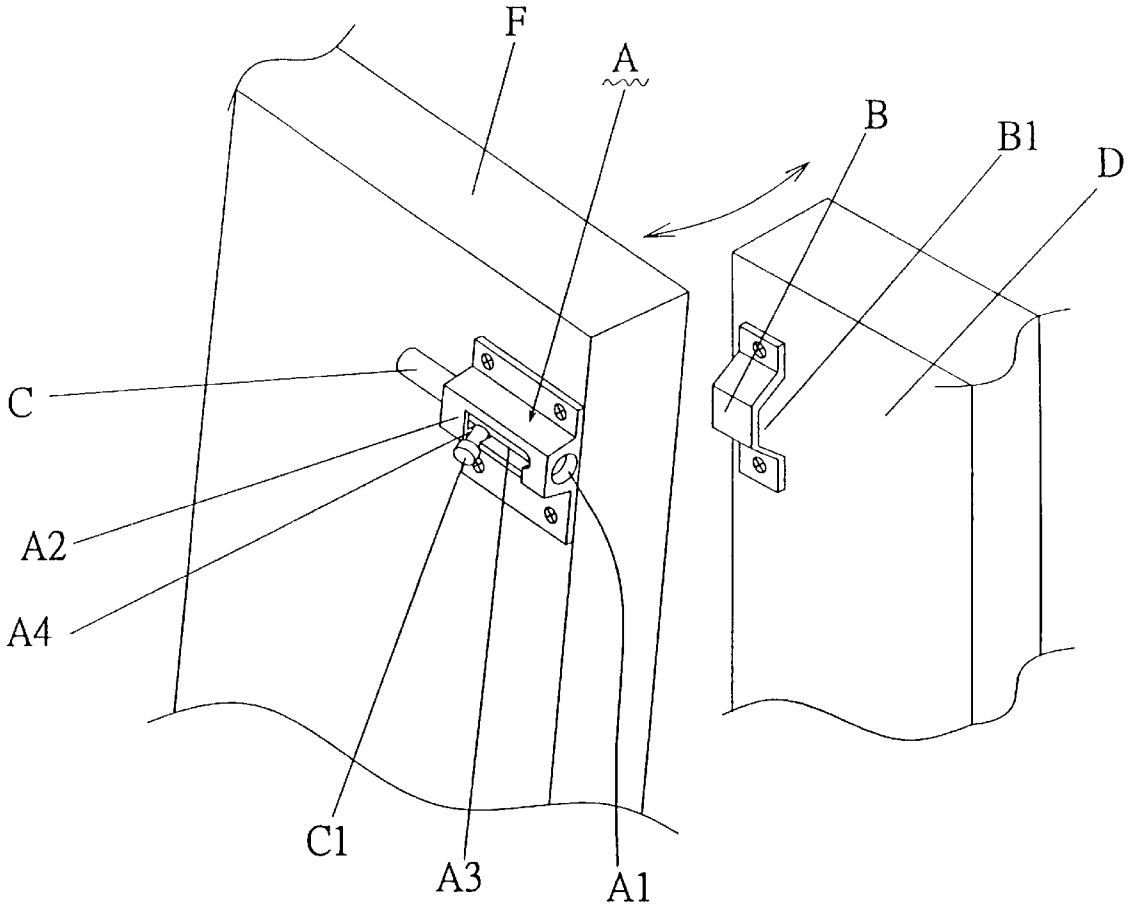
FIG:11 (Prior Art)
FIG. 11 is a perspective view showing a prior art locking device.
Figure 12:
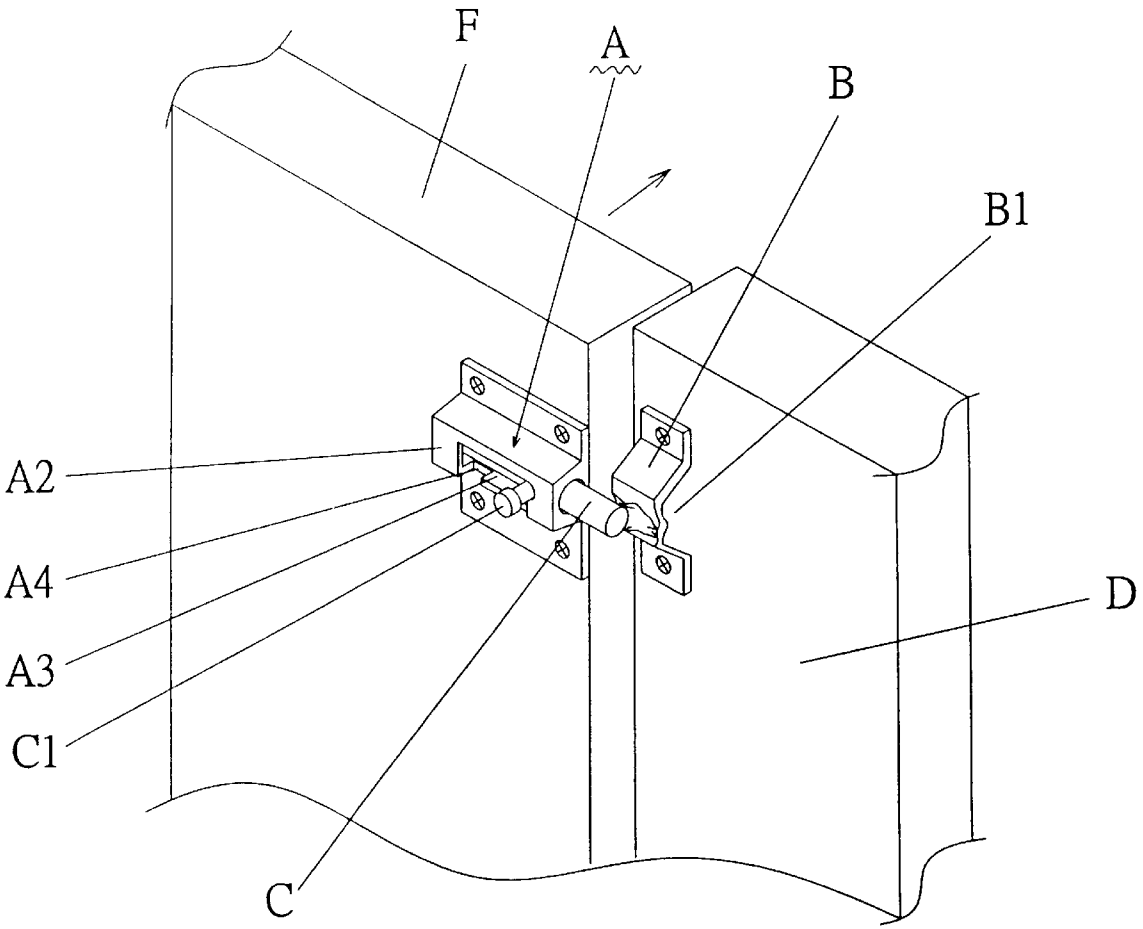
FIG:12 (Prior Art)
FIG. 12 is a perspective view schematically showing the impact between the prior art locking shaft and shaft receiver.

Referring to FIG. 1 and FIG. 2, the locking device for doors or windows of the present invention comprises:

a base member 20, the base member 20 includes an axially extended hole which has one end thereof being formed as an oblong-shaped hole 23 and the other end thereof being formed with a round opening 24, the oblong-shaped hole 23 having axially extended inner wall 233 (as shown in FIG. 6);

a locking shaft 30, from a front end of the locking shaft 30 there are formed in sequence with a ball-shaped handle 32, a circular ring 34, an oblong-shaped locking block 35 cooperating with the oblong-shaped hole 23, an elongated round rod 38 having a diameter no greater than the width of the locking block 35, and a thread portion 381 at the other end of the round rod 38 for connecting with a barrel-shaped locking head 39 which has a diameter greater than that of the round rod 38, wherein the locking block 35, round rod 38 and locking head 39 can be received in the oblong-shaped hole 23 and the round opening 24;

a spring 40 mounting around the round rod 38, the spring 40 having one end pushing on the inner wall 233 of the oblong-shaped hole 23 and the other end pushing on an inner surface 391 of the locking head 39 so as to provide a spring force keeping the locking shaft 30 at a pre-determined position relative to the base member 20 (as shown in FIG. 6).

Figure 4:
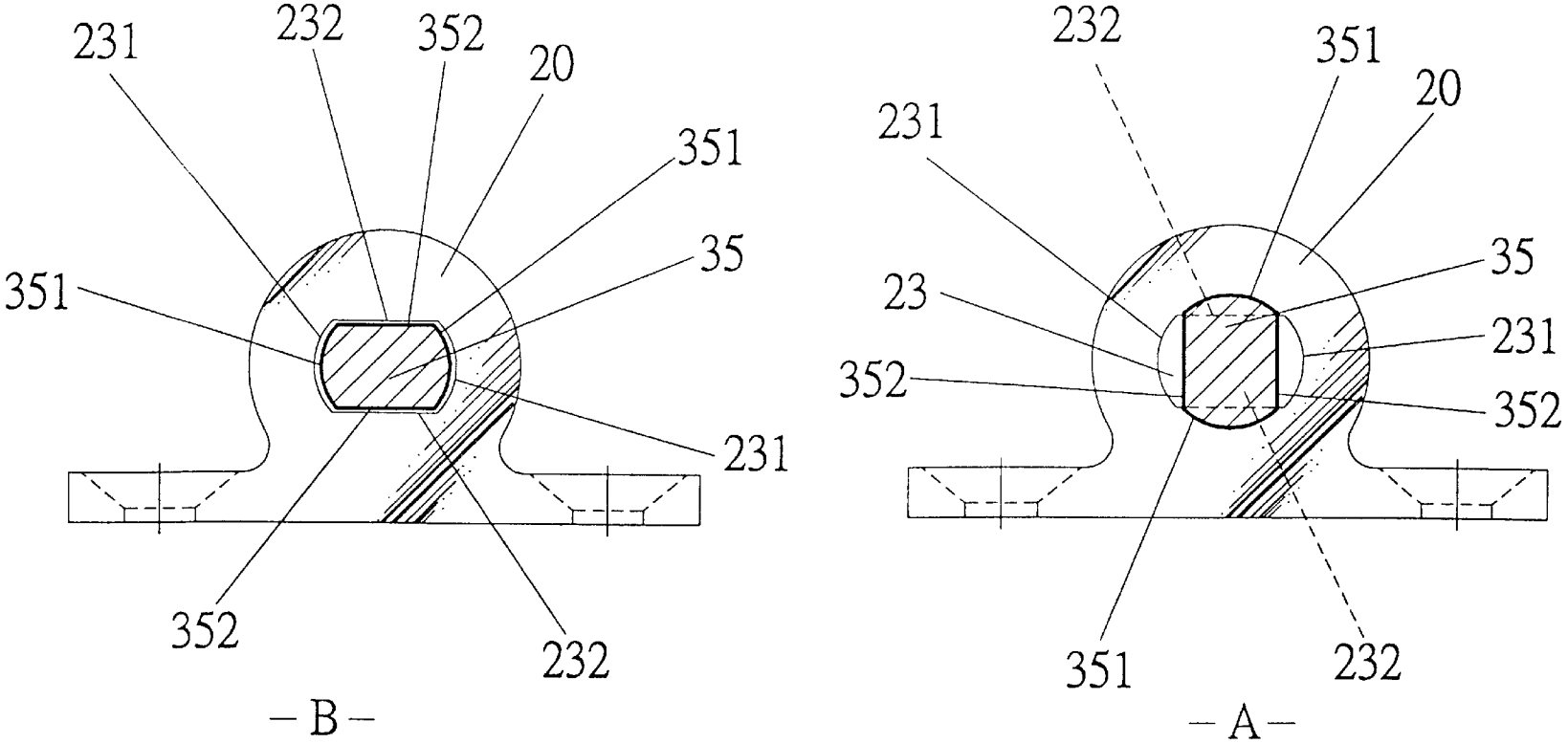
FIG. 4A and 4B show two sectional views of the locking device taken along line A—A shown in FIG. 3 (wherein the locking shaft 30 is turned for ninety degree in FIG. 4A).

Following the above described structure of the locking device, a positioning portion 382 may be defined at the conjunction of the locking block 35 and the round rod 38 due to the size difference between them. The positioning portion 382 can be optionally positioned to contact on an outer wall of the oblong-shaped hole 23 by firstly pulling out the locking shaft 30 until the positioning portion 382 exposed out of the oblong-shaped hole 23 and then turn the locking shaft 30 a desired angle (preferably ninety degree as shown in FIG. 4A).

Following the above described structure of the locking device, the base member 20 can be fixed on (or mounted within) a door/window 10 (or a frame 12 thereof). The locking head 39 can extend into a shaft hole 52 furnished on a cooperated frame 12 (or door/window 10), as shown in FIGS. 5, 6, 9 and 10.

Figure 5:
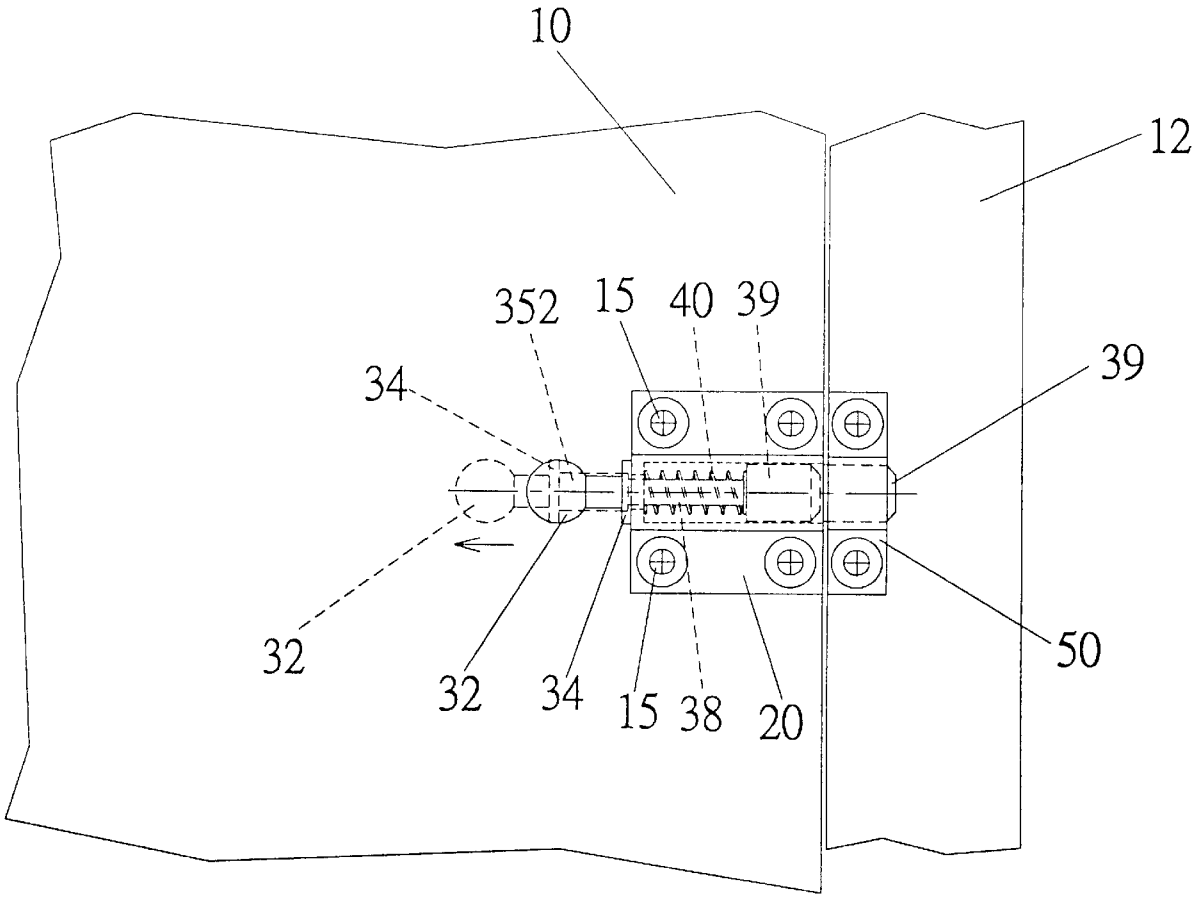
FIG. 5 is a top view schematically showing the locking device being furnished on a door/window.

Following the above described structure of the locking device, the structure of the embodiment and function thereof will be illustrated in a more detailed manner hereunder:

(1). Referring to FIG. 5 and FIG. 6, the base member 20 of the present invention can be fixed on or mounted within a door/window 10 or a frame 12 beside the door/window. If the base member 20 is fixed on the door/window 10, then a shaft receiver 50 having a shaft hole 52 should be fixed on the frame 12 at a location corresponding to the base member 20. When there is a need to close or lock the door/window 10 on the frame 12, the user uses his/her finger to turn the ball-shaped handle 32 and make the shaft to rotate a desired angle (preferably ninety degree). Until the curve-shaped contour 351 of the locking block 35 mates with the curve-shaped contour 231 of the oblong-shaped hole 23, and the linear-shaped contour 352 of the locking block 35 mates with the linear-shaped contour 232 of the oblong-shaped hole 23, the locking block 35 will automatically move into the oblong-shaped hole 23 (as shown in FIG. 4B) due to the spring force provided by the spring 40 so as to force the locking head 39 to run out of the round opening 24 and right plug into the shaft hole 52 of the shaft receiver 50 (as shown in FIG. 5 and FIG. 6). Therefore the function for locking the door/window 10 onto the frame 12 is achieved.

Figure 3:
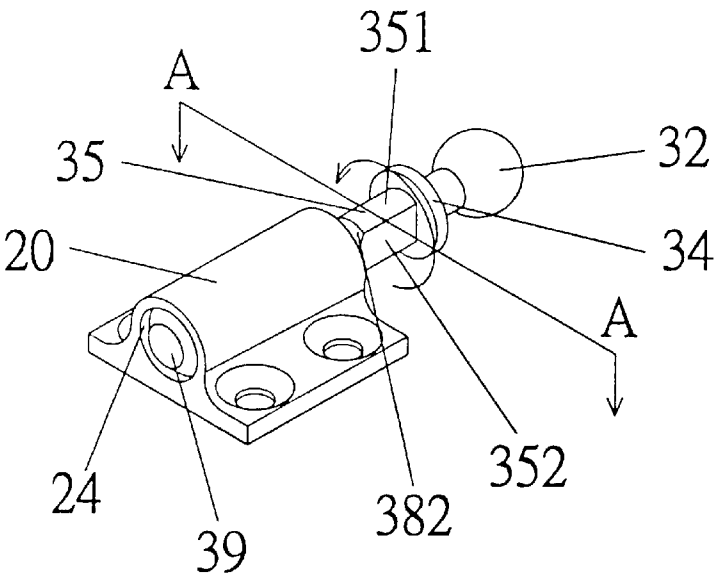
FIG. 3 shows an example for operating the locking device shown in FIG. 2.

(2). Referring to FIG. 3 and FIG. 4A, when there is a need to open the door/window 10 from the frame 12, the user may use his/her finger to pull the ball-shaped handle 32 outward until the positioning portion 382 exposed out of the oblong-shaped hole 23, and then rotate the locking shaft 30 a desired angle (preferably ninety degree).

Then the curve-shaped contour 351 of the locking block 35 will be positioned (or locked) on the linear-shaped contour 232 of the oblong-shaped hole 23. In the mean time, the locking head 39 of the locking shaft 30 will be received and secured inside the round opening 24 again. As the spring 40 is now compressed, the spring force provided by the spring 40 will force the locking block 35 pushing against (locking on) the outer contour of the oblong-shaped hole 23 from being loosened. Therefore no impact between the locking head 39 and shaft receiver 50 may possibly occur, and the door/window 10 can be open from the frame 12 freely as shown by the dotted line in FIG. 5 and FIG. 6.

(3). Referring to FIGS. 7, 8, 9 and 10, which illustrate another embodiment of the locking device in accordance with the present invention. Since the embodiment illustrated hereunder has a structure like the one described above, same elements will be assigned with same numerals and no detailed description will be given any more. The characteristic of the locking device shown in FIGS. 7, 8, 9 and 10 comprises: The base member 20 is designed to be a barrel shape and no screw hole are provided here. The base member 20 can be mounted (or buried) inside the door/window 10 (or the frame 12). On the frame 12 (or door/window 10), there is formed with a shaft hole 52 at a location corresponding to the base member 20. The shaft hole 52 can be formed by drilling a hole on the frame 12 (or door/window 10) and being used with an associated plate-shaped shaft receiver 50. Such that the locking head 39 of the base member 20 can proceed the functions of locking-into and releasing-out-of the shaft hole 52.

While several preferred embodiments of the present invention have been described and illustration, the invention should not be limited thereto but may be otherwise embodied within the scope of the following claims.

What is claimed is:

1. A locking device for doors or windows comprising:

a base member, including an axially extended hole which has one end being formed as an oblong-shaped hole and the other end being formed with a round opening, the oblong-shaped hole having an axially extended inner wall;

a locking shaft, from a front end of the locking shaft, there are formed in sequence with a ball-shaped handle, a circular ring, an oblong-shaped locking block cooperating with the oblong-shaped hole, an elongated round rod having a diameter no greater than the width of the locking block, and a thread portion at an end of the round rod for connecting with a locking head which has a diameter greater than the round rod, wherein the locking block, round rod and locking head can be received in the oblong-shaped hole and the round opening;

a spring mounting around the round rod, the spring having one end pushing on the inner wall of the oblong-shaped hole and the other end pushing on an inner surface of the locking head so as to provide a spring force keeping the locking shaft at a pre-determined position relative to the base member.

2. The locking device of claim 1, further comprising a positioning portion which is formed at the conjunction of the locking block and the round rod, the positioning portion can be optionally positioned on an outer wall of the oblong-shaped hole.

3. The locking device of claim 1, further comprising the base member adapted for attachment on said door or said window and the locking head can optionally plug into a shaft hole formed on a frame beside said door or said window.

4. The locking device of claim 1, further comprising the base member adapted to be mounted inside said door or said window and the locking head can optionally plug into a shaft hole drilled on a frame beside said door or said window.

5. The locking device of claim 1, further comprising the base member adapted for attachment on a frame and the locking head can optionally plug into a shaft hole formed on said door or said window.

6. The locking device of claim 1, further comprising the base member adapted to be mounted inside a frame and the locking head can optionally plug into a shaft hole drilled on said door or said window.

* * * * *